US008011741B2

(12) United States Patent
Mattle

(10) Patent No.: US 8,011,741 B2
(45) Date of Patent: Sep. 6, 2011

(54) FLAP DRIVE SYSTEM

(75) Inventor: Klaus Mattle, Koblach (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 12/579,521

(22) Filed: Oct. 15, 2009

(65) Prior Publication Data

US 2010/0026153 A1 Feb. 4, 2010

Related U.S. Application Data

(63) Continuation of application No. PCT/AT2008/000153, filed on Apr. 25, 2008.

(30) Foreign Application Priority Data

May 7, 2007 (AT) ..... A 696/2007

(51) Int. Cl.
*A47B 95/00* (2006.01)

(52) U.S. Cl. ..... 312/319.5; 312/328

(58) Field of Classification Search ..... 49/339, 49/340, 341, 345; 16/286, 79; 312/323, 312/327, 328, 325, 319.5–319.8, 116, 138.1, 312/139; 310/83; 318/663
See application file for complete search history.

(56) References Cited

U.S. PATENT DOCUMENTS

| | | | | |
|---|---|---|---|---|
| 2,912,237 | A | 11/1959 | Snyder | |
| 5,177,730 | A * | 1/1993 | Utsugi | 720/646 |
| 5,362,144 | A * | 11/1994 | Shioya et al. | 312/319.6 |
| 6,195,940 | B1 * | 3/2001 | Moy | 49/324 |
| 6,241,300 | B1 * | 6/2001 | Suzuki | 296/37.8 |
| 6,283,535 | B1 * | 9/2001 | Yuge | 296/146.8 |
| 6,682,157 | B2 * | 1/2004 | Ito | 312/319.6 |
| 7,178,202 | B2 * | 2/2007 | Hirtsiefer et al. | 16/366 |
| 7,240,974 | B2 * | 7/2007 | Hirtsiefer | 312/109 |
| 7,448,703 | B2 * | 11/2008 | Kung | 312/327 |
| 7,478,891 | B2 * | 1/2009 | Hollenstein | 312/319.2 |
| 7,500,287 | B2 * | 3/2009 | Brustle | 16/286 |
| 7,573,215 | B2 * | 8/2009 | Hillen | 318/280 |
| 7,707,687 | B2 * | 5/2010 | Giovannetti | 16/289 |
| 2006/0164230 | A1 * | 7/2006 | DeWind et al. | 340/461 |
| 2007/0180654 | A1 * | 8/2007 | Gasser | 16/242 |

(Continued)

FOREIGN PATENT DOCUMENTS

| | | |
|---|---|---|
| EP | 0 561 361 | 3/1993 |

(Continued)

OTHER PUBLICATIONS

International Search Report issued Aug. 14, 2008 in International (PCT) Application No. PCT/AT2008/000153.
Austrian Search Report issued Dec. 5, 2007 in Austrian Patent Application No. A 696/2007.

*Primary Examiner* — Janet M Wilkens
(74) *Attorney, Agent, or Firm* — Wenderoth, Lind & Ponack, L.L.P.

(57) ABSTRACT

A flap drive system for moving a flap mounted in a movable manner on the body of a piece of furniture has a mechanical actuating unit with an actuating arm that can be linked to the flap, and has an energy accumulator that can apply a force to the actuating arm. The flap drive system also has an electric drive secured to the actuating unit for driving the flap. The electric drive has at least one electric motor and is designed as a self-contained component, such that the electric drive can be secured to the actuating unit even when the actuating unit is already mounted on the body of the piece of furniture.

20 Claims, 12 Drawing Sheets

U.S. PATENT DOCUMENTS

| | | | | |
|---|---|---|---|---|
| 2008/0054771 | A1* | 3/2008 | Brunnmayr | 312/323 |
| 2008/0121490 | A1* | 5/2008 | Dubach et al. | 192/17 D |
| 2008/0122332 | A1 | 5/2008 | Brustle | |
| 2009/0261696 | A1* | 10/2009 | Hollenstein et al. | 312/327 |
| 2009/0265992 | A1* | 10/2009 | Hass et al. | 49/340 |
| 2010/0043595 | A1* | 2/2010 | Mattle | 74/625 |
| 2010/0327717 | A1* | 12/2010 | Huber et al. | 312/319.5 |

FOREIGN PATENT DOCUMENTS

| | | |
|---|---|---|
| WO | 2005/040956 | 5/2005 |
| WO | 2006/099645 | 9/2006 |
| WO | 2007/035971 | 4/2007 |

* cited by examiner

FLAP DRIVE SYSTEM

This application is a Continuation of International application No. PCT/AT2008/000153, filed Apr. 25, 2008.

BACKGROUND OF THE INVENTION

The present invention relates to a flap drive system for a flap mounted in a movable manner on the body of a piece of furniture.

WO 2006/099645 A1 discloses a flap mounted in a movable manner on the body of a piece of furniture with a mechanical actuating unit having an actuating arm which can be connected to the flap and an energy accumulator which acts on the actuating arm. Furthermore, an electric motor for driving the flap is provided as an integral component of the mechanical actuating unit. A flap drive system with constructional units or components which are closed off from one another is not disclosed.

FIG. 1 shows a mechanical actuating unit according to the prior art which is mounted on the body 8 of a piece of furniture via a base plate 9. The mechanical actuating unit has in this case an energy accumulator 13 for acting on two actuating arms 10, 11. The actuating arms 10, 11 are, on the one hand, articulated to the base plate 9 and, on the other hand, articulated to a fitting part 12 of the flap 4. The actuating arm 10, and thus the flap 4, can be driven via an electric motor 7.

Drawbacks of the prior art include, on the one hand, the fact that a decision, once made, for a purely mechanical actuating unit or a mechanical actuating unit with an integrated electric motor may be altered only by way of a complete exchange of the mechanical actuating unit for a unit with or without an integrated electric motor. In other words, it is not possible to retrofit a mechanical actuating unit, which has already been installed in the body of a piece of furniture, with an electric motor. If the electric motor has to be exchanged due to a defect, this requires the entire mechanical actuating unit to be taken apart or the entire actuating unit with the defective electric motor to be exchanged for an actuating unit with an intact electric motor.

SUMMARY OF THE INVENTION

The object of the invention is to eliminate these problems of the prior art.

This object is achieved by providing a flap drive system in which the electric motor is arranged in an electric drive. The electric drive is embodied as a closed-off component, so that the electric drive can be fastened to the actuating unit, which is present as a closed-off constructional unit, even when the actuating unit is already mounted on the body of the piece of furniture. This also allows a defective electric drive to be exchanged without having to remove the mechanical actuating unit from the body of the piece of furniture.

The electric motor can be fastened, for example, without tools, preferably by way of a snap connection, or by way of a screw connection or in another suitable manner. Suitable fastening means must be arranged on the mechanical actuating unit and/or the electric drive for fastening the electric drive to the mechanical actuating unit.

The simplest embodiment of the electric drive as a closed-off component is achieved in that all the components of the electric drive are fastened to a common base plate. In this case, the base plate of the electric drive can be fastened to the mechanical actuating unit. The base plate can of course be completely or at least partially sheathed by a housing to protect the components of the electric drive.

Alternatively, provision may also be made for all the components of the electric drive to be arranged in a common housing. In this case, it is not necessary for all the components to be fastened to the base plate of the housing.

Particularly preferred is an embodiment of the invention in which provision is made for the drive force to be transmitted from the electric drive to the actuating unit via a preferably single interface. This interface can be formed, for example, by a shaft journal which connects an output of the electric motor or a gear mechanism arranged on sides of the electric drive to the mechanical actuating unit. The shaft journal is in this case, for example, non-rotatably introduced into an opening on the actuating unit. In this case, provision may for example be made for the interface to interact directly with the actuating arm of the actuating unit, so that the flap is driven via the electric motor, the interface and the actuating arm.

Of course, a gear mechanism may also be provided in the drive chain between the electric motor and the actuating arm.

Particularly preferably, in the embodiment with the interface, for the interface to establish, as it were automatically, a connection is provided for transmitting force between the electric drive and the actuating unit as a result of the fastening of the electric drive to the actuating unit. This may be carried out, in the embodiment of the actuating unit as a shaft journal, in such a way that the shaft journal is fastened to the electric drive and engages, during the fastening of the electric drive as a result of its positioning, with a corresponding withdrawal opening on the actuating unit.

If the actuating unit has a housing with a base which can be fastened to the body of the piece of furniture and a covering surface set apart from the base, the electric drive can be fastened to the covering surface. Alternatively, the electric drive can be fastened to the actuating unit, laterally next to the actuating unit. In both cases, it is not necessary to remove the actuating unit from the body of the piece of furniture, for fastening the electric drive, if the actuating unit is already mounted on the body of the piece of furniture.

Very generally, the electric drive can be fastened to the actuating unit before the actuating unit is mounted on the body of the piece of furniture. In this case, the key advantage of the invention over the prior art consists in the fact that the electric drive may easily be removed from the actuating unit once the actuating unit has been mounted. This is advantageous, for example, in the case of a defective electric motor.

If provision is made for the electric drive to have a gear mechanism, provision may furthermore be made for the interface to be coupled to the gear mechanism on the side of the electric drive. This embodiment affords the advantage that no modification of pre-existing mechanical actuating units is required, provided that the units have an interface.

In a further preferred embodiment of the invention, a coupling can be connected between the at least one electric motor and the interface or between the at least one electric motor and the gear mechanism.

The coupling can be embodied, for example, in a mechanically flexible manner (for example as a hose coupling). A mechanically flexible embodiment of this type of the coupling helps to reduce transmission of the drive noise of the electric motor to the gear mechanism and if appropriate the housing part in which the gear mechanism is arranged. This is important to the extent that preferably the electric motor is mounted in a floating manner in the housing of the electric drive and therefore itself gives off hardly any vibrations to the housing. The acoustic properties of the electric drive may be further improved if provision is made for additional weights to be connected to the at least one electric motor. This allows the ratio between the stator mass and rotor mass of the electric motor to be advantageously altered.

The electric motor can be mounted in a floating manner with the aid of foam pads.

Alternatively or additionally, the electric drive can have a freewheeling coupling for the at least one electric motor. A freewheeling coupling of this type is described in the aforementioned WO 2006/099645 A1 and therefore does not have to be commented on in greater detail at this point.

For various reasons, it may be advantageous if a position measuring device is provided for determining the position of the actuating arm. Alternatively or additionally, provision may be made to provide a position measuring device for determining the electric motor. That is to say, in particular in the case of the arrangement of a freewheeling coupling, it is not necessarily possible to conclude from a known position of the actuating arm or electric motor the position of the other of the two components, the actuating arm and electric motor. In this case, it is advantageous if separate position measuring devices are provided for each component (actuating arm and electric motor respectively). It is of course also possible to provide a common position measuring device having separate sensors for the actuating arm and the electric motor respectively.

At least one of the position measuring devices can in this case have a rotary potentiometer. Other embodiments of the position measuring device(s) are also conceivable.

The measurement signals from the position measuring device or position measuring devices can be supplied to an open or closed-loop controller. The open or closed-loop controller can control the electric motor in an open or closed loop as a function of the measurement signals received. For example, it is possible to implement in this way a touch-latch functionality in which the electric motor is triggered and/or braked for driving the flap as a result of a user acting on the flap. Furthermore, it is also possible to traverse various speed or acceleration profiles, including as a function of the intensity and/or direction of a force exerted by the user.

Furthermore, it is also possible to determine by way of the position measuring devices derived movement variables of the electric motor and/or the flap such as, for example, rotational acceleration and rotational speed or acceleration and speed.

As the flap is not always readily accessible (above all for relatively small users) in the fully opened state, it is possible to provide on the body of the piece of furniture a separate switch which can be used to carry out the closing. If the switch is provided only for the closing, it is concealed by the flap in the closed end position of the flap, in which the flap rests against the body of the piece of furniture. Nevertheless, the process of closing by the electric motor can of course also be started by way of a movement of the flap by the user.

A flap drive system according to the invention can be arranged on one or both sides of the body of a piece of furniture. In the case of an arrangement on both sides, one of the flap drive systems (or the open or closed-loop control unit thereof) can function as the master and the other flap drive system (or the open or closed-loop control unit thereof) as the slave.

BRIEF DESCRIPTION OF THE DRAWINGS

Further advantages and details of the invention will emerge from the figures and also the description of the figures pertaining thereto. In the drawings.

DETAILED DESCRIPTION OF THE INVENTION

FIGS. 2 to 5 show a first exemplary embodiment of a flap drive system 1 according to the invention.

Figure 1:
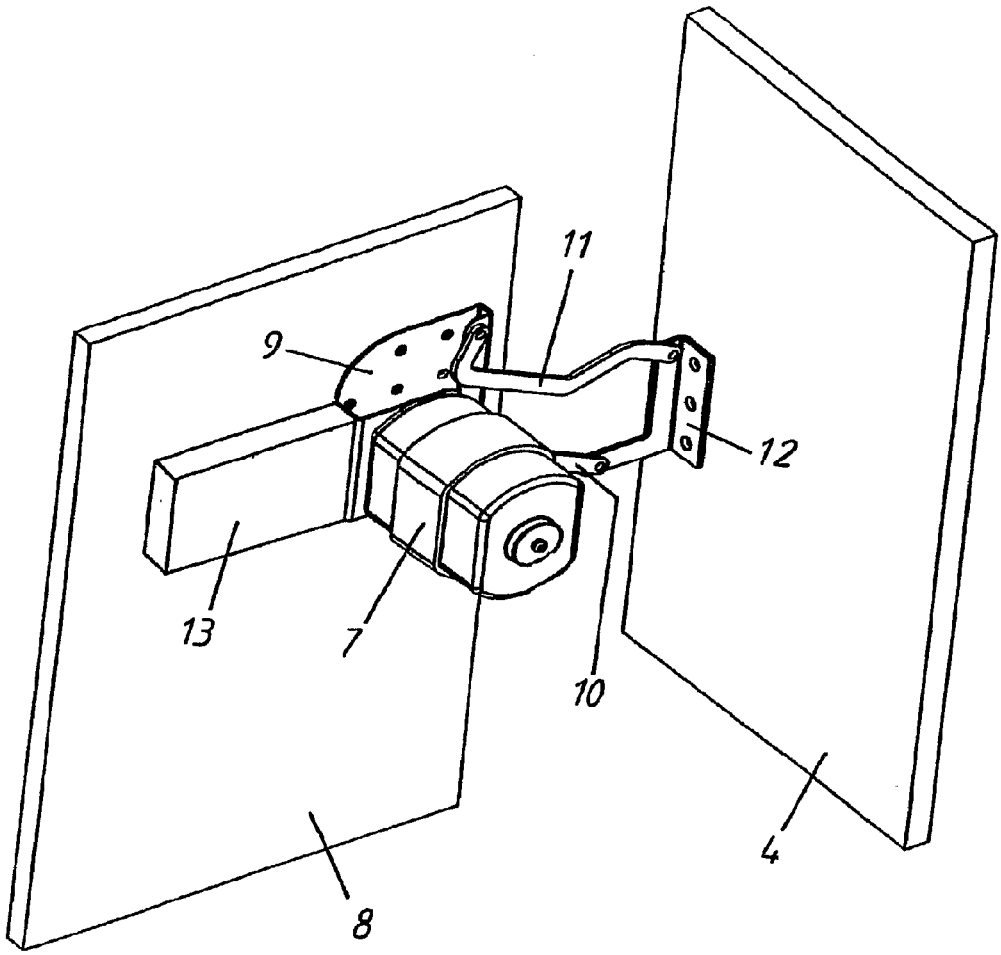
PRIOR ART Fig.1
FIG. 1 shows a mechanical actuating unit for a flap with an electric motor according to the prior art.
Figure 2:
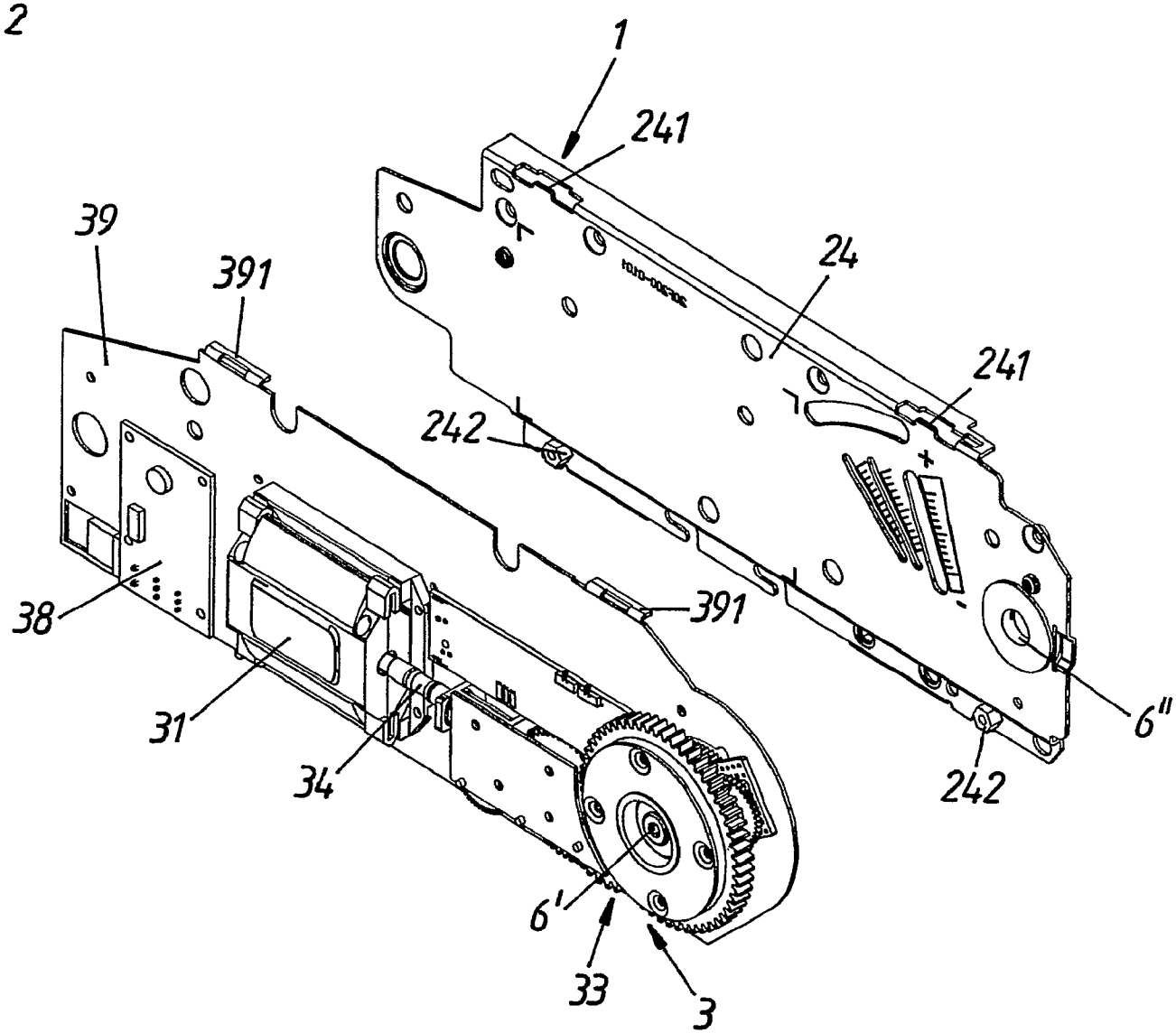
FIGS. 2 to 5 are various views of a first exemplary embodiment of a flap drive system according to the invention.

FIG. 2 shows in this case a covering surface (covering plate) 24 of a mechanical actuating unit 2 (which is not shown in greater detail in FIG. 2). The covering surface 24 has two projections 241 which serve to suspend (support) the base plate 39 of the electric drive 3. The suspending is carried out in this case via tabs 391. Once the suspending has been carried out, the electric drive 3 and the mechanical actuating unit 2 can be screwed to each other via screws (see FIG. 5), the covering surface 24 having in this exemplary embodiment appropriate receptacles 242 for the screws. FIG. 2 also shows the gear mechanism 33, the electric motor 31 and also a coupling 34 (which is in this exemplary embodiment embodied in a mechanically flexible manner) joining these two components together. A printed circuit board 38, which comprises the circuits of an open or closed-loop control unit, is also fastened to the base plate 39.

The interface 6 is in this case embodied in the form of the central shaft 6' of the electric drive 3 and a receptacle (not shown), arranged after a receptacle opening 6" on the actuating unit 2, for the shaft 6'.

Figure 3:
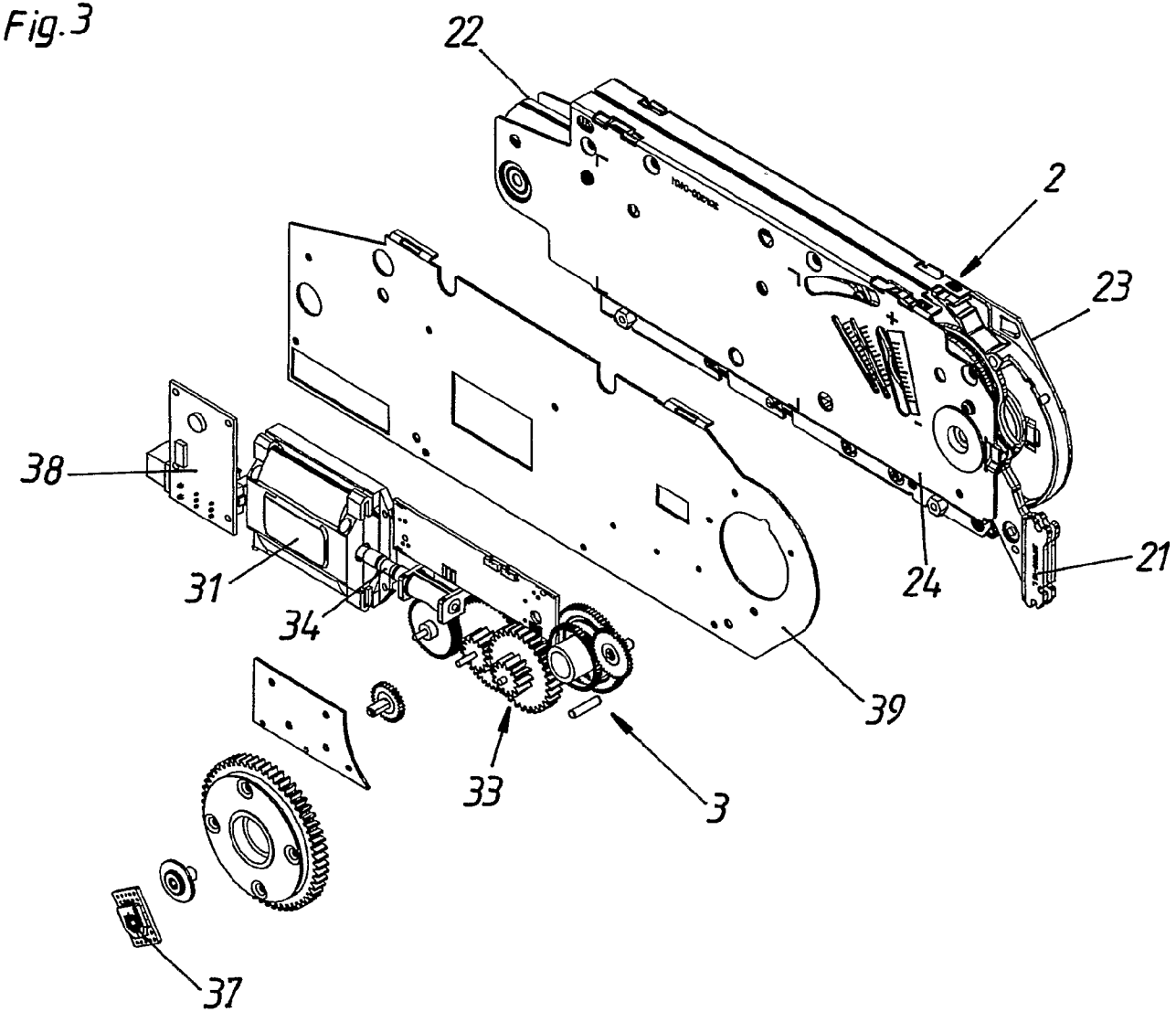

FIG. 3 shows the mechanical actuating unit 2 as a total unit such as may already be fastened in the body of a piece of furniture (not shown in FIG. 3). The mechanical actuating unit 2 has in this case an actuating arm 21 which is acted on by an energy accumulator 22 (in this case: a spring assembly) which is not shown in greater detail in FIG. 3 but corresponds to the prior art.

The housing of the actuating unit 2 has a base 23 which can be used to fasten the actuating unit 2 to the body of a piece of furniture. The covering surface 24, which serves to fasten the electric drive 3 to the actuating unit 2, is set apart from the base and substantially parallel thereto (i.e., the covering surface 24 opposes the base 23).

Figure 4A:
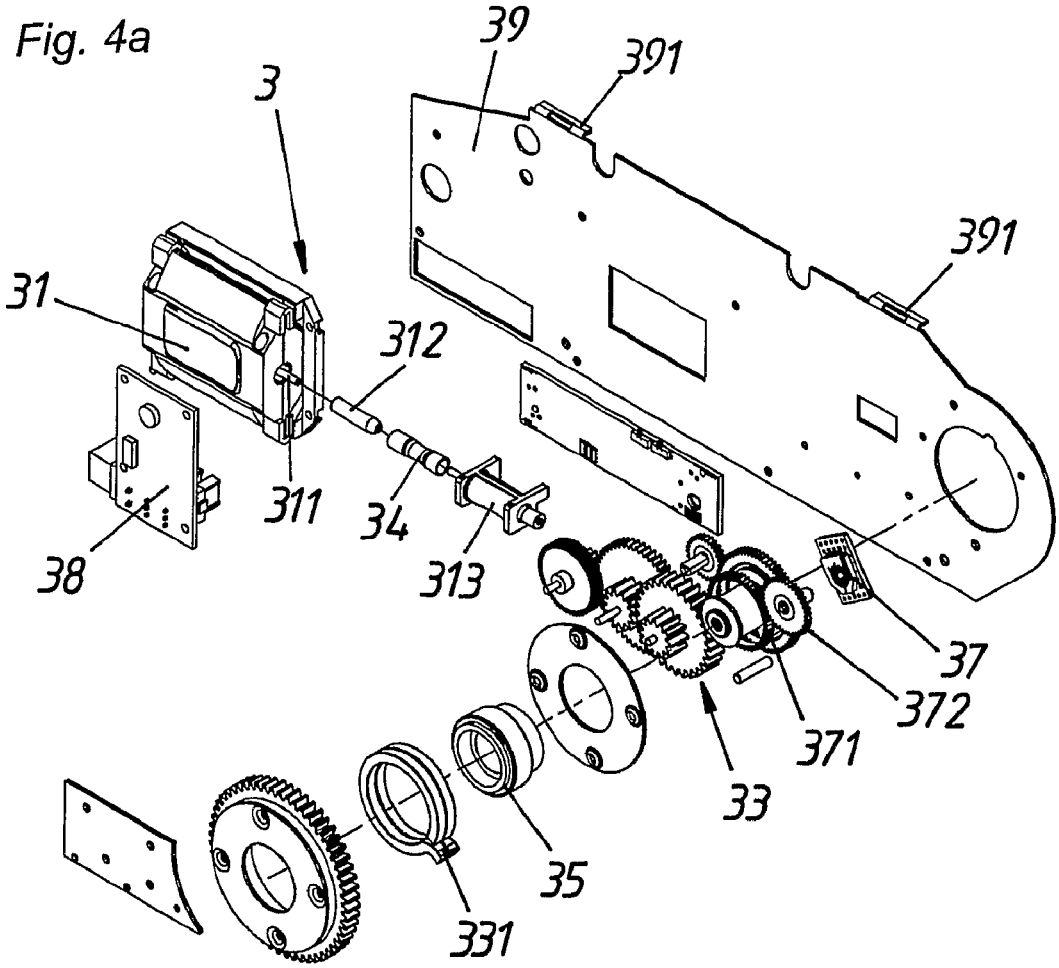
Figure 4B:
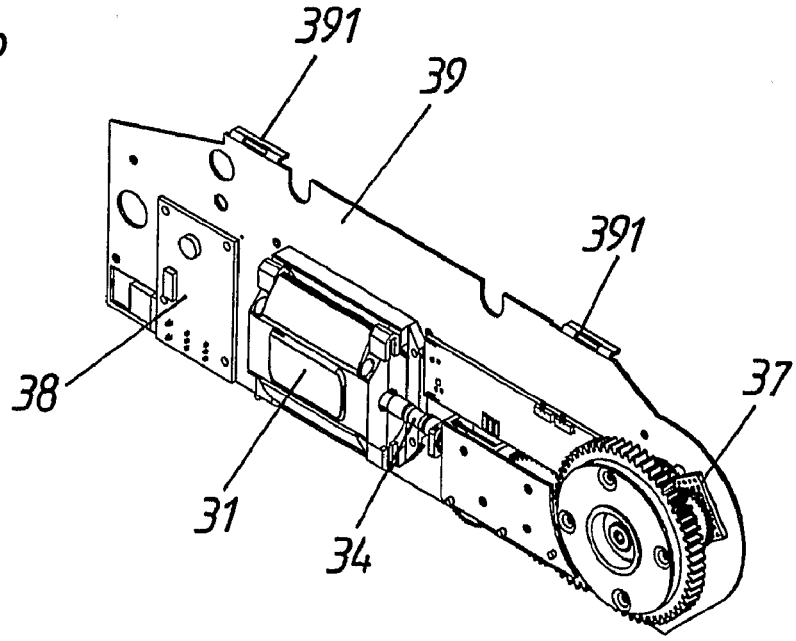

In relation to the electric drive 3, FIG. 3 shows, in comparison to FIG. 2, a potentiometer 37 which interacts with the end stage of the gear mechanism 33 (see for this purpose the exploded view of FIG. 4). The position of the actuating arm 21, and thus the position of the flap 4 (not shown in FIG. 3), can be determined via the potentiometer 37, as the end stage of the gear mechanism 33 interacts with the actuating arm 21 without slippage via the interface 6 (not shown in FIG. 3).

A further potentiometer, which is embodied directly on the printed circuit board 38 by suitable connections, is not shown separately in the figures. The position of the output of the electric motor 31 can be determined via this potentiometer.

FIG. 4 shows the actual arrangement of the potentiometer 37 relative to the gear mechanism 33. In this case, a toothed rim 371 is rotationally engaged with the end stage of the gear mechanism 33 and interacts with a toothed wheel 372 in such a way that the movement of the end stage of the gear mechanism 33 is transmitted to the toothed wheel 372 at a ratio of 2:1. This allows the measuring range of the potentiometer 37, with which the toothed wheel 372 interacts, to be utilized more effectively.

FIG. 4 also shows that a pin 312, which is inserted into the coupling 34 (in this case: a mechanically flexible hose coupling), is attached to the output 311 of the electric motor 31. On the other side of the coupling 34, a worm wheel, which interacts with the first stage of the gear mechanism 33, is arranged in a housing 313.

The electric drive 3 also has an overload coupling 331 as well as a freewheeling coupling 35. The overload coupling 331 prevents in this case accidental destruction of the toothed wheels of the gear mechanism 33 as a result of excessive loads acting on the actuating arm 21. The freewheeling coupling 35 allows a user to intervene while the flap 4 is being driven, without the motor 31 preventing him from doing so.

Figure 5:
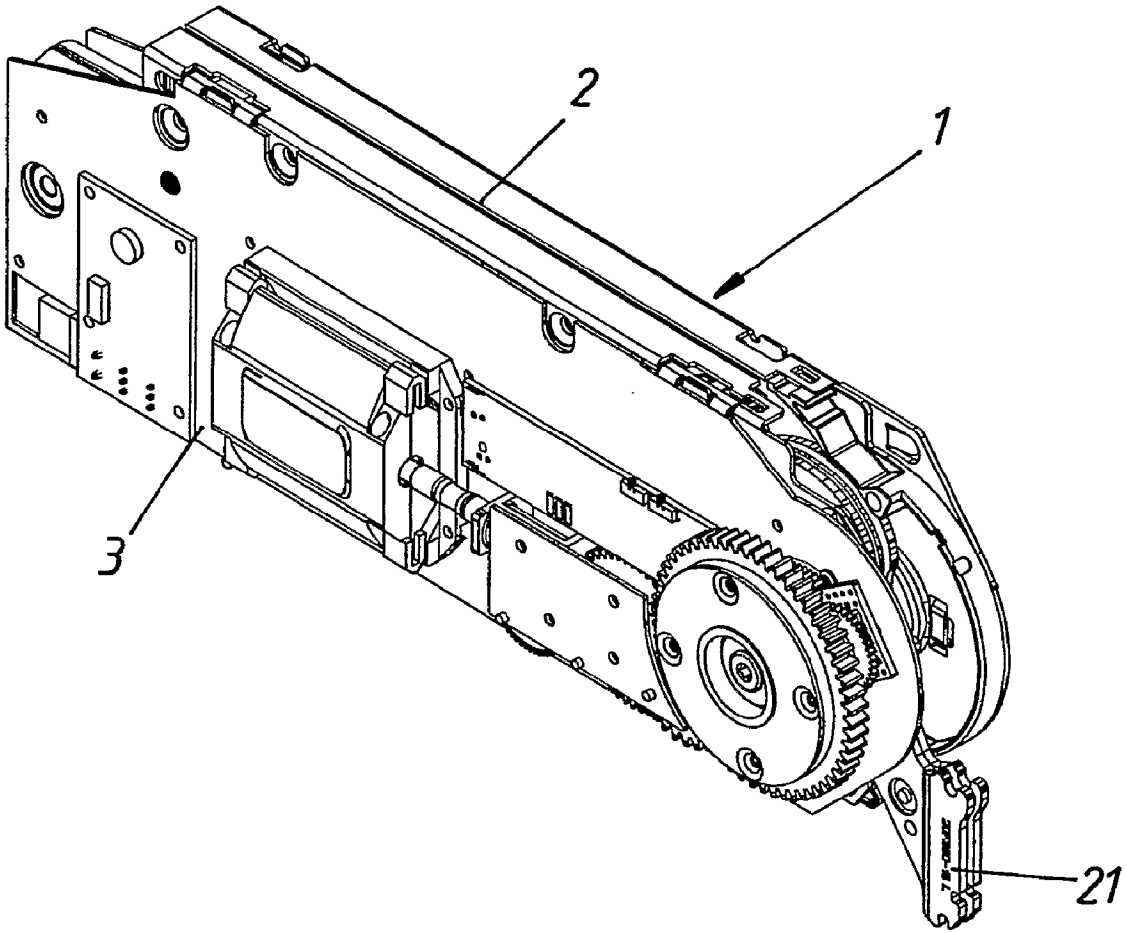

FIG. 5 is a perspective view of, again, the flap drive system 1 according to the foregoing FIGS. 2 to 4, the electric drive 3 being fastened, as a closed-off component, to the mechanical actuating unit 2.

Although a key advantage of the invention consists in the fact that it is possible to fasten the electric drive 3 to an actuating unit 2 even when the actuating unit 2 is already mounted on the body 5 of a piece of furniture (not shown here), the flap drive 1 can of course also be prefabricated in the form shown in FIG. 5. (This also applies, of course, to the embodiment commented on hereinafter in FIGS. 6 to 11).

Figure 6:
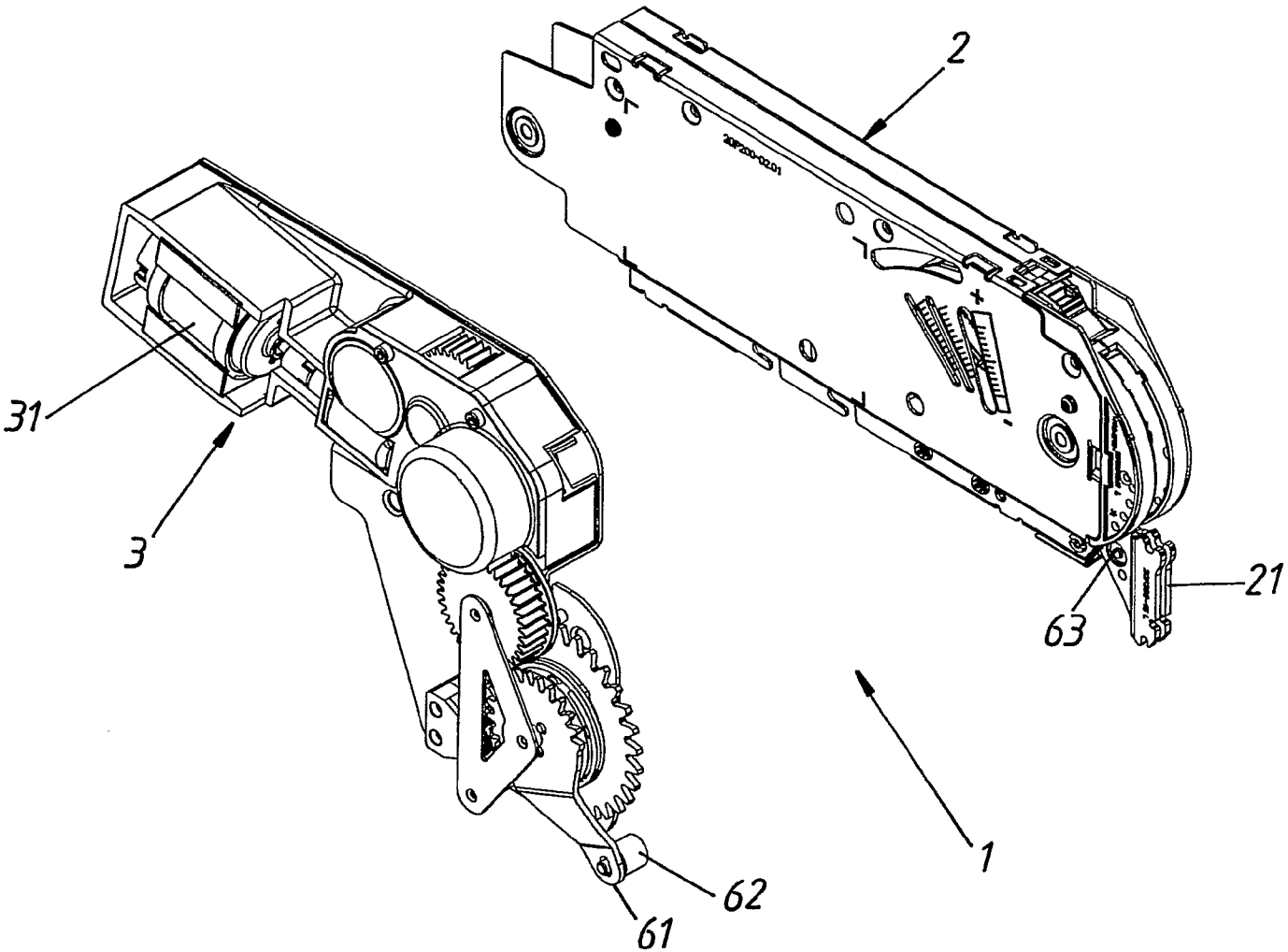
FIGS. 6 to 11 show a second exemplary embodiment of a flap drive system according to the invention.

FIG. 6 shows a second exemplary embodiment of a flap drive system 1 according to the invention consisting of a mechanical actuating unit 2 and an electric drive 3 before the electric drive 3 is mounted on the actuating unit 2.

FIG. 6 shows the embodiment of the interface 6 in the form of an arm 61 which can be driven by the electric motor 31 and to which a bolt 62 is fastened. The bolt 62 engages in this case, during the mounting of the electric drive 3 on the actuating unit 2, with a recess 63 on the actuating unit 2. This creates a force-transmitting connection between the electric drive 3 and the actuating unit 2.

Figure 7:
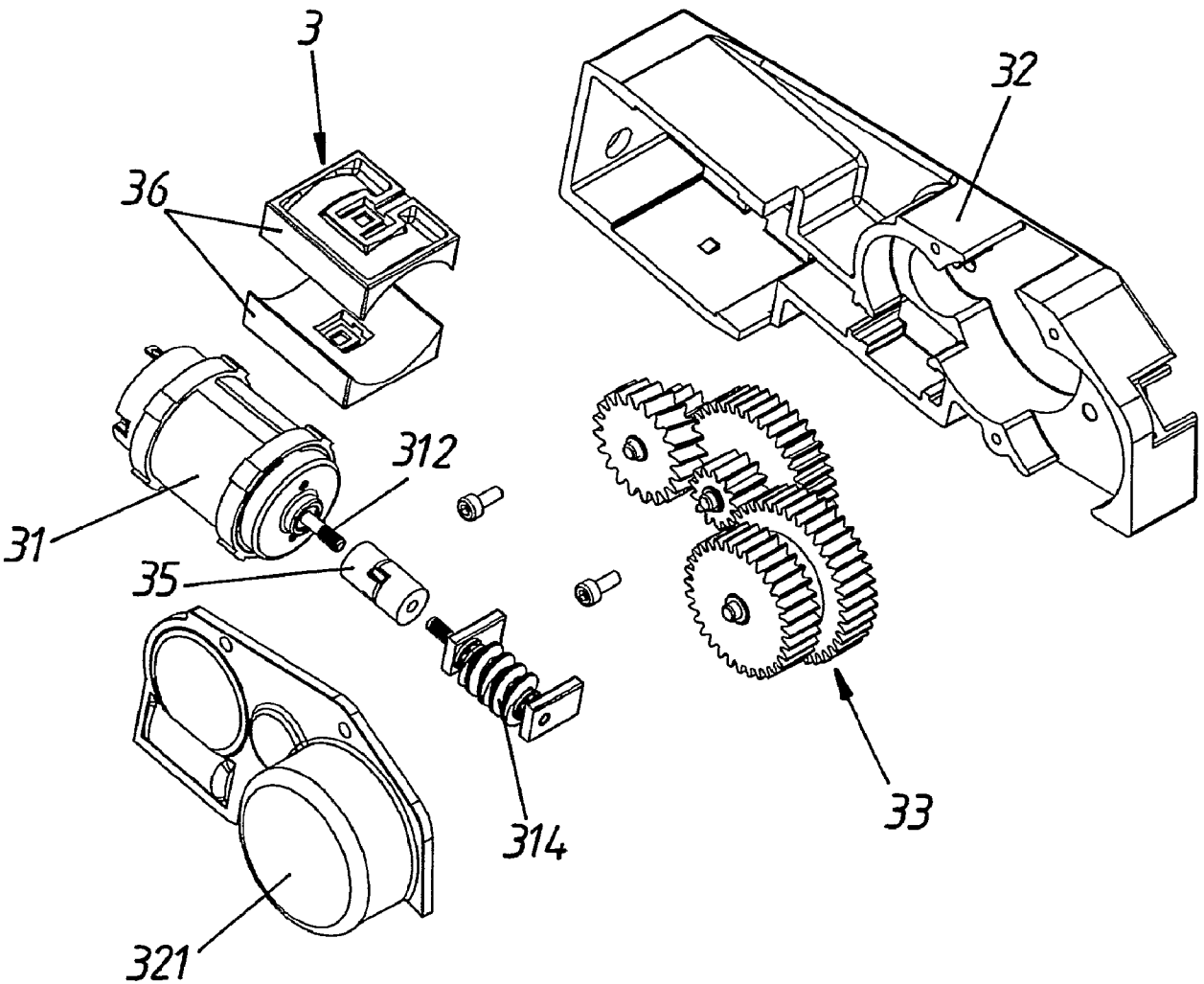

FIG. 7 is an exploded view of the electric drive 3.

All the components of the electric drive 3 are in this case arranged in a housing 32. The housing 32 can be covered by a cover 321.

The electric motor 31 is arranged in a floating manner in a motor mount. In this case, weights 36 are arranged (in a manner which may not be seen) in the motor mount. The output 312 of the electric motor 31 interacts with a worm wheel 314 via a freewheeling coupling 35 (in this case: a claw coupling). The worm wheel 314 drives the arm 61 via the gear mechanism 33.

Figure 8:
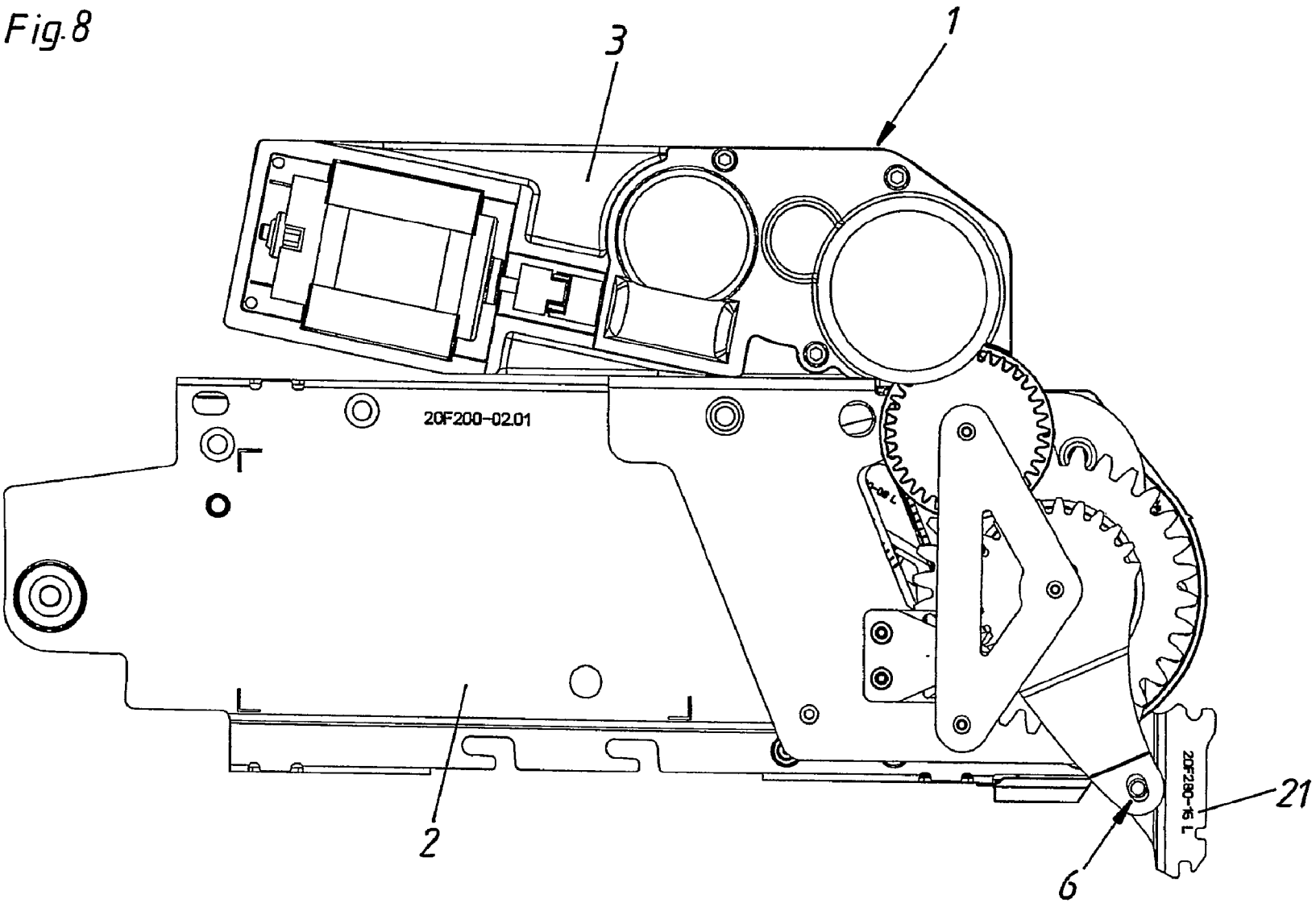

FIG. 8 is a plan view of the flap drive system 1 according to the invention, wherein the electric drive 3 has already been fastened to the actuating unit 2.

Figure 9:
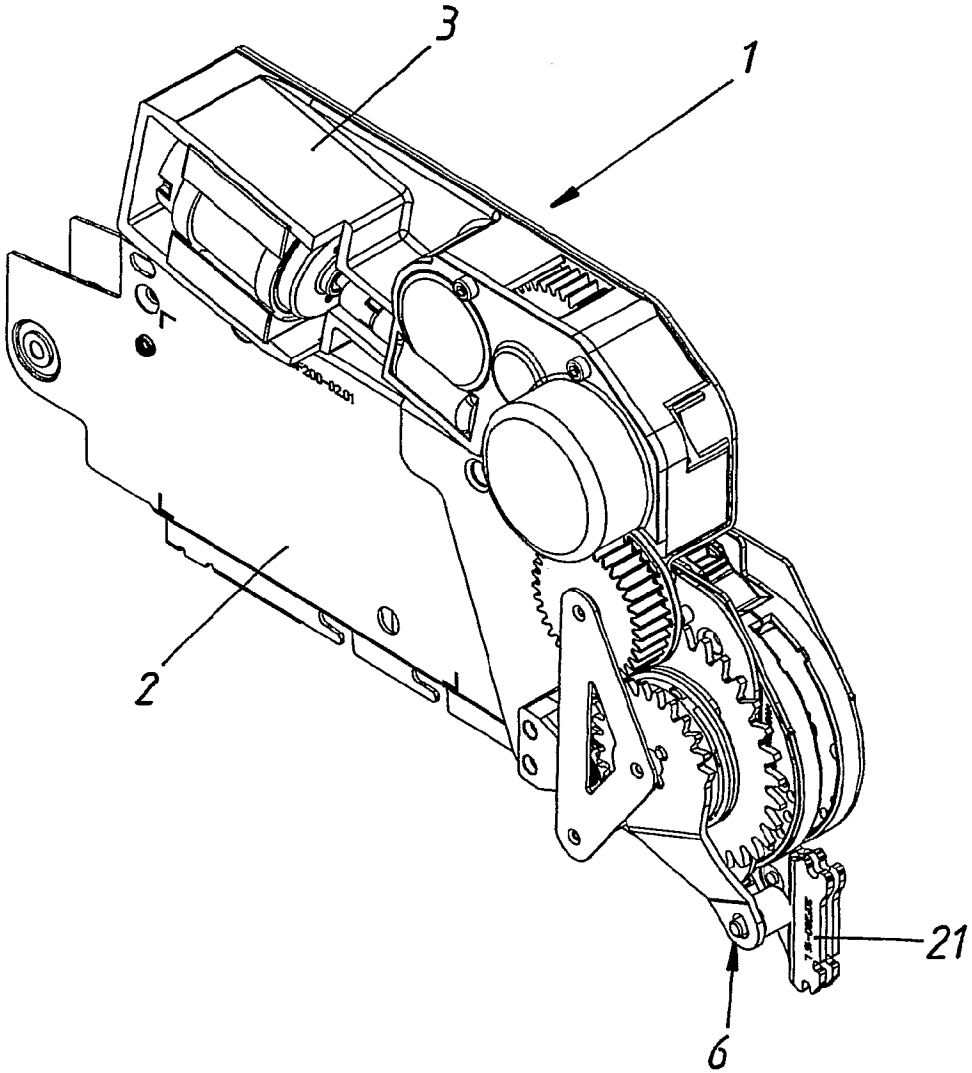

FIG. 9 is a corresponding perspective view.

Figure 10:
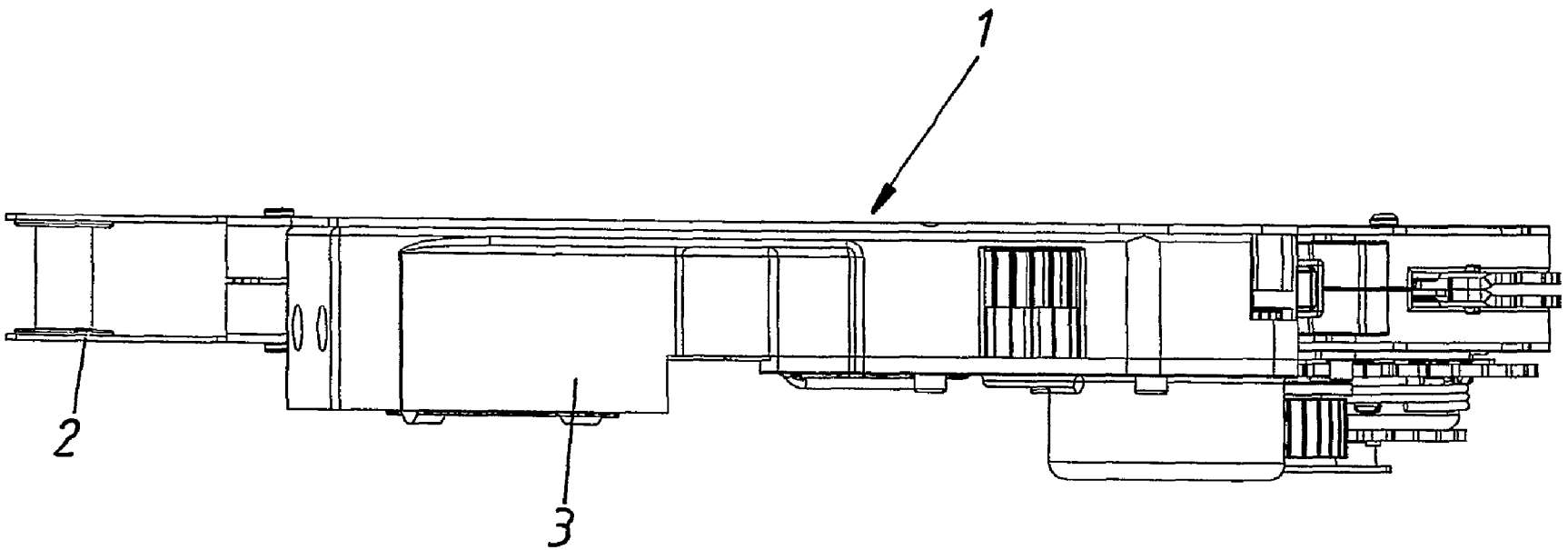
Figure 11:
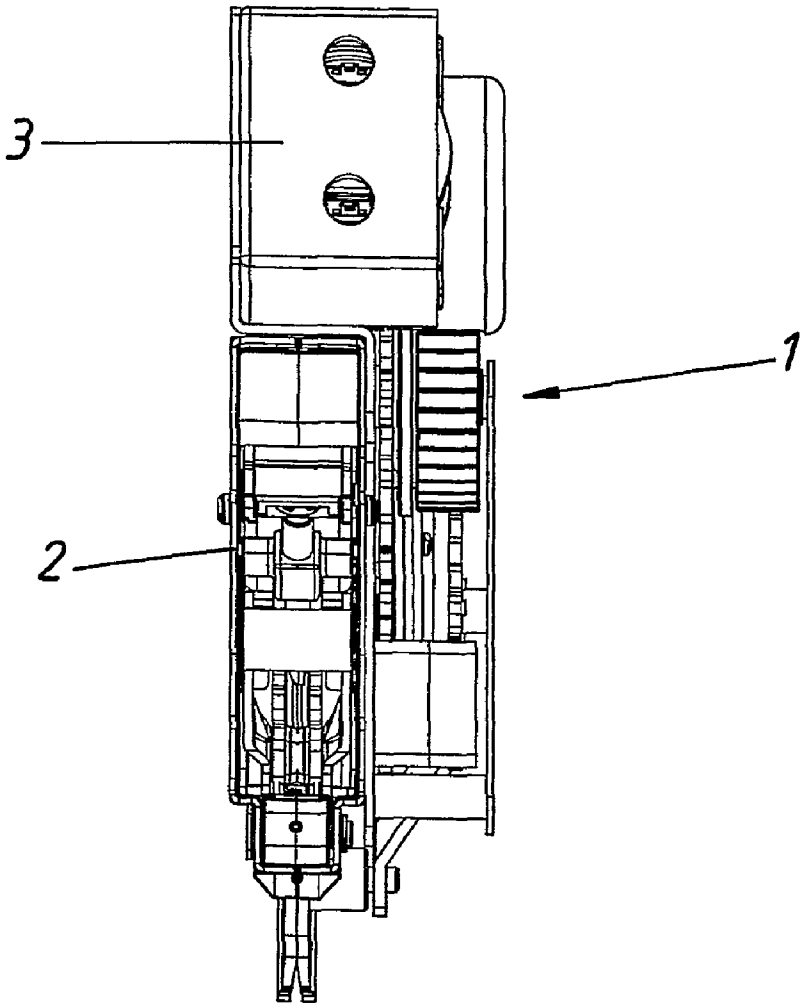

FIGS. 10 and 11 are a plan and front view, respectively.

Figure 12B:
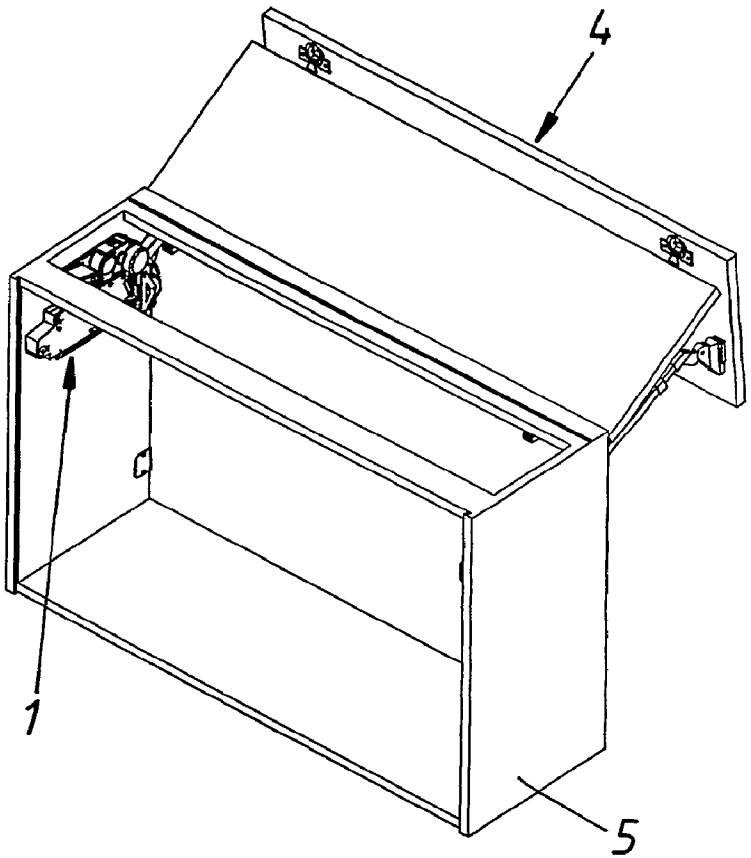
FIGS. 12*a*, 12*b* are each a perspective view of the body of a piece of furniture with a mounted flap drive system according to the first or second exemplary embodiment.
Figure 12A:
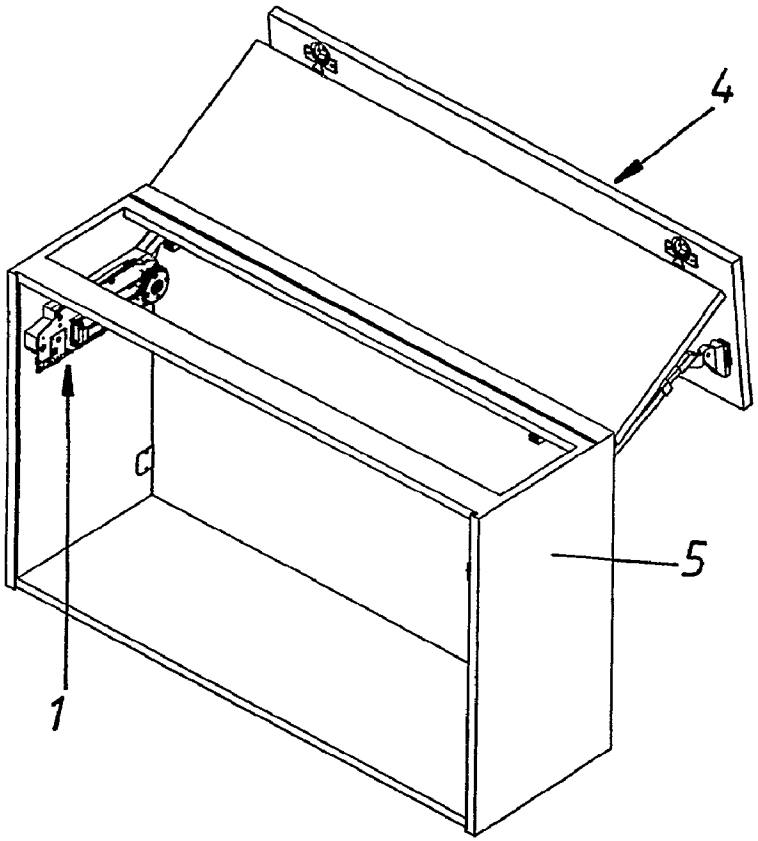

FIG. 12*a* shows the body 5 of a piece of furniture with a flap 4 mounted thereon in a movable manner and a flap drive system 1 according to FIGS. 2 to 5.

FIG. 12*b* shows the body 5 of a piece of furniture with a flap 4 mounted thereon in a movable manner and a flap drive system 1 according to FIGS. 6 to 11.

The invention claimed is:

1. A flap drive system for driving a flap movably mounted on a body of a piece of furniture, said flap drive system comprising:

a mechanical actuating unit including:

a housing having a base to be fastened to the body of the piece of furniture and having a covering plate apart from and opposing said base;

an actuating arm to be connected to the flap, said actuating arm being arranged between said base and said covering plate of said housing; and an energy accumulator for acting on said actuating arm, said energy accumulator being arranged between said base and said covering plate of said housing;

an electric drive including an electric motor and a base plate detachably fastened to said covering plate of said actuating unit; and an interface between said electric drive and said actuating unit, said interface being configured to transmit driving force from said electric motor to said actuating arm when said base plate of said electric drive is detachably fastened to said covering plate of said actuating unit, wherein said electric drive is configured to be detachably fastened to said actuating unit without disassembling said actuating unit when said actuating unit is already mounted to the body of the piece of furniture.

2. The flap drive system of claim 1, wherein said interface comprises a central shaft coupled to said electric drive, and said interface further comprises a receptacle unit on said actuating unit for engaging said central shaft when said base plate of said electric drive is detachably fastened to said covering plate of said actuating unit.

3. The flap drive system of claim 1, wherein all components of said electric drive are fastened to said base plate.

4. The flap drive system of claim 1, wherein said electric drive further includes a housing, all components of said electric drive being arranged in said housing of said electric drive.

5. The flap drive system of claim 1, wherein said interface is configured to establish a connection for transmitting the driving force between said electric drive and said actuating unit as a result of detachably fastening said electric drive to said actuating unit.

6. The flap drive system of claim 1, wherein said electric drive is detachably fastened to said actuating unit so as to be located laterally adjacent to said actuating unit.

7. The flap drive system of claim 1, wherein said electric drive further includes a gear mechanism.

8. The flap drive system of claim 7, wherein said interface is coupled to said gear mechanism of said electric drive.

9. The flap drive system of claim 8, wherein said interface is further coupled to said actuating arm of said actuating unit.

10. The flap drive system of claim 7, wherein said interface comprises a central shaft coupled to said gear mechanism of said electric drive, and said interface further comprises a receptacle unit on said actuating unit for engaging said central shaft when said base plate of said electric drive is detachably fastened to said covering plate of said actuating unit.

11. The flap drive system of claim 1, wherein said interface is coupled to said actuating arm of said actuating unit.

12. The flap drive system of claim 1, wherein said electric drive further includes a coupling between said electric motor and said interface.

13. The flap drive system of claim 12, wherein said coupling comprises a mechanically flexible coupling.

14. The flap drive system of claim 1, wherein said electric drive further includes a freewheeling coupling linked to said electric motor.

15. The flap drive system of claim 1, wherein said electric drive further includes a housing for accommodating said electric motor therein, said electric motor being mounted so as to float within said housing of said electric drive.

16. The flap drive system of claim 1, wherein said electric drive further includes additional weights connected to said electric motor.

17. The flap drive system of claim 16, further comprising a position measuring device including a rotary potentiometer for measuring an amount of movement of said actuating arm.

18. The flap drive system of claim 1, further comprising a position measuring device for determining a position of at least one of said actuating arm and said electric motor.

19. The flap drive system of claim 1, wherein said actuating arm and said energy accumulator are arranged within said housing between an inner surface of said covering plate and an inner surface of said base, and said base plate of said electric drive is detachably fastened to an outer surface of said covering plate.

20. A piece of furniture comprising:

a body member;

a flap member movably mounted to said body member; and a flap drive system for driving said flap member, said flap drive system comprising:

a mechanical actuating unit including:

a housing having a base fastened to said body member and having a covering plate apart from and opposing said base;

an actuating arm connected to said flap member, said actuating arm being arranged between said base and said covering plate of said housing; and an energy accumulator for acting on said actuating arm, said energy accumulator being arranged between said base and said covering plate of said housing;

an electric drive including an electric motor and a base plate detachably fastened to said covering plate of said actuating unit; and an interface between said electric drive and said actuating unit, said interface being configured to transmit driving force from said electric motor to said actuating arm when said base plate of said electric drive is detachably fastened to said covering plate of said actuating unit, wherein said electric drive is configured to be detachably fastened to said actuating unit without disassembling said actuating unit when said actuating unit is mounted to said body member.

* * * * *